United States Patent [19]

Cochran et al.

[11] Patent Number: 4,812,103

[45] Date of Patent: Mar. 14, 1989

[54] IMPLEMENT-COUPLING ASSEMBLY FOR MATERIAL-HANDLING APPARATUS

[75] Inventors: Gary L. Cochran, Racine; Ronald D. Seeley, Waterford; Donald G. Shelton, Burlington, all of Wis.; Gary D. Stromberg, Derby, Kans.

[73] Assignee: J. I. Case Company, Racine, Wis.

[21] Appl. No.: 171,864

[22] Filed: Mar. 22, 1988

[51] Int. Cl.[4] ..... E02F 3/28

[52] U.S. Cl. ..... 414/723; 172/272; 403/11

[58] Field of Search ..... 414/723; 403/11; 172/272–275; 280/461 R, 461 A

[56] References Cited

U.S. PATENT DOCUMENTS

| | | |
|---|---|---|
| 2,963,183 | 12/1960 | Przybylski . |
| 3,204,793 | 9/1965 | Lane . |
| 3,220,487 | 11/1965 | Pilch . |
| 3,231,117 | 1/1966 | Melroe et al. . |
| 3,269,570 | 8/1966 | Wallberg . |
| 3,672,521 | 6/1972 | Bauer et al. . |
| 3,732,996 | 5/1973 | Bauer . |
| 3,794,195 | 2/1974 | Clevenger et al. . |
| 3,818,551 | 6/1974 | Coughran, Jr. . |
| 4,545,720 | 10/1985 | Cochran et al. . |

FOREIGN PATENT DOCUMENTS

| | | |
|---|---|---|
| 91351 | 3/1958 | Norway . |
| 975029 | 11/1964 | United Kingdom . |

*Primary Examiner*—Robert J. Spar
*Assistant Examiner*—Donald W. Underwood
*Attorney, Agent, or Firm*—Dressler, Goldsmith, Shore, Sutker & Milnamow, Ltd.

[57] ABSTRACT

An improved coupling assembly enabling a bucket to be selectively coupled to and uncoupled from a front-end loader with lifting and tilting means. A female coupling structure is integral with the bucket. A back plate of the female coupling structure bears against a front plate of a male coupling structure with no gap between such plates. An upper flange on the front plate bears upwardly against an upper flange on the back plate. Means are provided to latch the male coupling structure releasably to the female coupling structure. Vertical play between the male coupling structure and the female coupling structure is limited precisely to a specified gap between and adjustable member on the male coupling structure and a fixed block on the female coupling structure.

21 Claims, 2 Drawing Sheets

IMPLEMENT-COUPLING ASSEMBLY FOR MATERIAL-HANDLING APPARATUS

FIELD OF THE INVENTION

This invention pertains generally to material-handling apparatus, such as front-end loaders, and particularly to an implement-coupling assembly of an improved design. The implement-coupling assembly enables an implement, such as a bucket, to be selectively coupled to and uncoupled from such an apparatus.

BACKGROUND OF THE INVENTION

Front-end loaders, which in common versions are known also as skid-steer loaders, are exemplified in Melroe et al. U.S. Pat. No. 3,231,117. Such loaders are used with various implements including dirt buckets, grain buckets, and manure forks, and are used commonly on farms or construction sites or in other harsh environments.

Typically, such a loader has, at its front end, lifting and tilting means, such as a pair of hydraulically operated load-lifting arms, which are journalled at their distal ends to a male coupling structure, and a pair of hydraulically operated load-tilting pistons, which also are journalled at their distal ends to the male coupling structure.

Typically, each implement for such a loader is provided with a female coupling structure, which is welded integrally to such implement. The male coupling structure is adapted to be selectively coupled to and uncoupled from the female coupling structure. When the male coupling structure is coupled to the female coupling structure, the implement may be selectively lifted and lowered, by means of the load-lifting arms, and may be selectively tilted, by means of the load-tilting pistons. It is known to employ hydraulically or manually actuated pins, wedges, or similar components to latch the male coupling structure releasably to the female coupling structure.

Various examples of such coupling structures, as known heretofore, are disclosed in Lane U.S. Pat. No. 3,204,793, Wallberg U.S. Pat. No. 3,269,570, Bauer et al. U.S. Pat. No. 3,672,521, Cochran et al. U.S. Pat. 4,545,720, and Kewacos Norwegian Patent No. 91,351. Other known structures of related interest are disclosed in Przybylski U.S. Pat. No. 2,963,183, Pilch U.S. Pat. No. 3,220,487, Bauer U.S. Pat. No. 3,732,996, Clevenger et al. U.S. Pat. No. 3,794,195, and Steelfab British Patent Specification No. 975,029.

In a typical arrangement, the female coupling structure comprises an upstanding back plate, which may be an integral part of the implement or a plate welded to the implement, an upper flange extending rigidly from the back plate and sloping downwardly and backwardly, and a lower flange extending rigidly and backwardly from the back plate, and the male coupling structure comprises an upstanding front plate, which may have an upper flange extending rigidly from an upper edge of the front plate and sloping upwardly and frontwardly, and paired brackets, which are used to mount the male coupling structure operatively to the lifting and tilting means of the material-handling apparatus. In such an arrangement, the male and female coupling structures respectively have welded steel parts.

In such an arrangement, the upper flange on the front plate of the male coupling structure or the upper edge of that plate, if such a flange is not used, is adapted to bear against the upper flange of the female coupling structure when the male coupling structure is being coupled to or uncoupled from the female coupling structure, and while the male coupling structure remains coupled to the female coupling structure. Conventional manufacturing tolerances for welded structures such as these leave a gap or space between the male and female coupling structures, as between the front plate of the male coupling structure and the back plate of the female coupling structure, when the upper flange of the front plate of the male coupler structure or the upper edge of that plate, if such a flange is not used, bears against the upper flange of the female coupling structure. The Bauer et al. patent noted above discloses, in specific reference to FIG. 12 of that patent, a gap or space between the front plate of the male coupling structure and the back plate of the female coupling structure, as an intended feature.

If the gap or space therebetween is too small, interference between adjacent parts of the male coupling structure and the female coupling structure may hamper or prevent proper coupling and uncoupling action. If the gap or space therebetween is too large, vertical play between the male coupling structure and the female coupling structure may permit excessive distortion, particularly under heavy loads, and may permit the implement to fall off the material-handling apparatus. Moreover, if the gap or space therebetween is too large, the aforementioned pins, wedges, or similar components may not be fully engaged in their receptacles when the male and female coupling structures are coupled to each other, whereby the implement may tend to fall off the material-handling apparatus.

There has been a need, therefore, to control any gap or space between the male and female coupling structures within precise limits and yet to employ conventional manufacturing tolerances for welded parts of the implement-coupling assembly.

Hereinabove, and hereinbelow, directional terms such as "front", "back", "frontwardly", "backwardly", "upper", and "lower", are used merely for convenience reference to relative positions of different parts and to relative directions and not intended as limiting.

SUMMARY OF THE INVENTION

This invention is addressed to the need noted above and provides an improved coupling assembly, which can be advantageously used o enable a material-handling implement, such as a bucket, to be selectively coupled to and uncoupled from a material-handling apparatus, such as a front-end loader, which has lifting and tilting means.

Broadly, this invention provides an improvement in a coupling assembly comprising a female coupling structure and a male coupling structure, which is adapted to be pivotally inserted into the female coupling structure such that the male and female coupling structures are capable of relative movement after the male coupling structure has been inserted into the female coupling structure.

The improvement is such that the coupling assembly comprises a fixed block, which is mounted fixedly to a selected one of the male and female coupling structures, preferably the female coupling structure, and an adjustable member, which is mounted adjustably to the other one of the male and female coupling structures, preferably the male coupling structure. The fixed block and adjustable member respectively have abutment surfaces, which face each other after the male coupling structure has been inserted into the female coupling structure.

The adjustable member is adjustable to a selected position such that the abutment surfaces are spaced from each other by a selected distance. In instances where the implements are to be changed frequently, the adjustable member may be left in the selected position of adjustment. The selected distance is sufficiently large to permit the male coupling structure to be pivotally inserted in the female coupling structure. The selected distance is sufficiently small to prevent the male and female coupling structures from inadvertently disengaging from each other despite relative movement between the male and female coupling structures. In other instances where a given implement is to be utilized for a prolonged period, the adjustable member may be adjusted and secured in a position where its abutment surface is located in surface-to-surface contacting engagement with the abutment surface of the fixed block. This provides essentially a rigid connection between the male and female coupling members which eliminates any movement therebetween during use. When it is desired to change the implement, the adjustable member will again be adjusted to a clearance position, so that the male coupling member can be withdrawn from the female coupling member.

In a particularly useful construction contemplated by this invention, a female coupling structure is welded, riveted, bolted, or attached otherwise so as to be integral with the implement. Also, the implement and female coupling structure together include a back plate, which may be a separate plate, and which must be a separate plate if the implement does not have a suitable plate, such as a plate providing a wall of the implement. Even if the implement has such a plate, a separate plate is preferred, as a reinforcing and strengthening component. Moreover, the implement and female coupling structure together include an upper flange extending rigidly and backwardly from the back plate and having a downwardly sloping lower surface, as well as a block mounted with respect to the back plate. The block has an upper surface.

In the particularly useful construction noted above, a male coupling structure, which is adapted to be operatively mounted to the lifting and tilting means of the material-handling apparatus, includes an upstanding front plate having a front surface, which is adapted to be generally parallel with and preferably to bear against the back surface of the back plate when the male coupling member is coupled to the female coupling member. Preferably, when the male coupling member is coupled to the female coupling member, there is no gap or space between the front plate and the back plate. Likewise, the male coupling member includes an upper flange extending rigidly above the front plate and having a sloping upper surface, which is adapted to bear against the lower surface of the upper flange of the female coupling structure when the male coupling structure is coupled to the female coupling structure. Moreover, means are provided for latching the male coupling structure releasably to the female coupling structure when the male coupling structure is coupled to the female coupling structure. If hydraulically or mechanically actuated pins, wedges, or similar components are used to latch the male coupling structure to the female coupling structure, since no gap or space is needed between the front and back plates noted above, such components can be fully engaged, whereby the implement can be securely coupled to the material-handling apparatus.

Furthermore, the male coupling structure includes a vertical bracket extending rigidly and backwardly from the front plate and a member mounted to the vertical bracket. The member has a lower surface. Either the block or the member, preferably the member, is mounted so as to be adjustable, when the male coupling structure is coupled to the female coupling structure, so that the lower surface of the adjustable member is spaced from the upper surface of the block by a selected gap, which may be precisely limited, as by means of a gauge inserted between such surfaces. The bracket may be one bracket of two pairs of brackets, as used to mount the male coupling structure to the lifting and tilting means of the material-handling apparatus.

Preferably, a lower flange extends rigidly and backwardly from the back surface of the back plate, and the block is mounted rigidly on the lower flange. Preferably, if the lower flange is included, the male coupling structure does not directly engage the lower flange when the male coupling member is coupled to the female coupling member.

Whether or not the lower flange is included, the selected gap between the lower surface of the member and the upper surface of the block serves as a maximum limit to vertical play between the male and female coupler members. Preferably, as noted above, there is no gap or space between the front and back walls. Therefore, conventional manufacturing tolerances may be employed for welded parts of the male and female coupling structures, even if a greater gap might be thus left between such a lower flange and nearest portions of the male coupling structure when the upper flange on the front plate of the male coupling structure or the upper edge of that plate, if such a flange were not used, would bear against the upper flange of the female coupling structure.

In a preferred embodiment of this invention, the improved coupling assembly comprises a pair of similar female coupling structures, each as described above, and a pair of similar male coupling structures, each as described above. Thus the implement is provided on each side with one of the female coupling structures. Also, one of the male coupling structures is mounted operatively to components of the lifting and tilting means on each side of the material-handling apparatus.

These and other objects, features, and advantages of this invention will be evident from the following description of the preferred embodiment of this invention, with reference to the accompanying drawings.

BRIEF DESCRIPTION OF THE DRAWINGS

FIG. 2 shows the female coupling structures noted above, as mounted integrally to the implement and uncoupled from the male coupling structures noted above.

DETAILED DESCRIPTION OF PREFERRED EMBODIMENT

Figure 1:
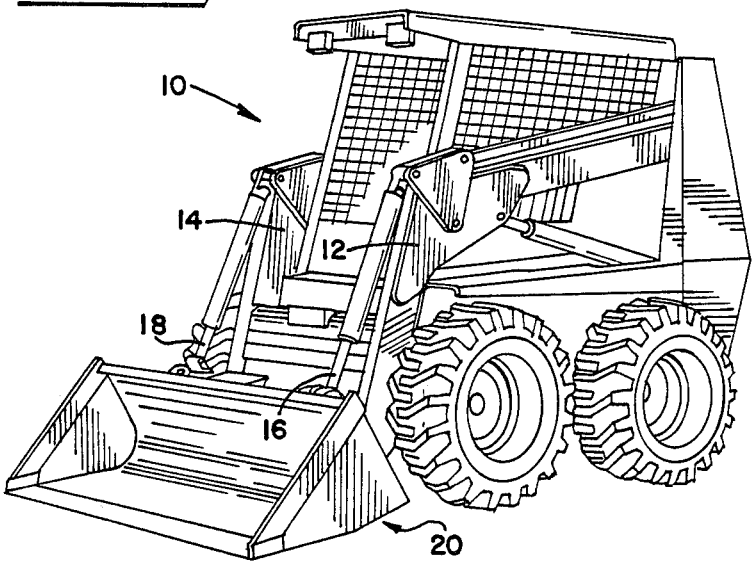
FIG. 1 is a perspective view of a skid-steer loader and an implement, which is coupled to the skid-steer loader by means of an implement-coupling assembly comprising a pair of male coupling structures and a pair of female coupling structures and constituting a preferred embodiment of this invention.

As shown in FIG. 1, a skid-steer loader 10, which may be also called a front-end loader, has, at its front end, a pair of hydraulically operated, load-lifting arms 12, 14, and a pair of hydraulically operated ,load-tilting, piston-cylinder mechanisms respectively including load-tilting pistons 16, 18. A bucket 20, which is a representative example of various implements that are useful with such a loader, is coupled to the loader 10, in a manner to be hereinafter described, so that the bucket 20 may be selectively lifted and lowered, by means of the load-lifting arms 12, 14, and so that the bucket 20 may be selectively tilted, by means of the load-tilting pistons 16, 18. Similar loaders have been made and sold for many years by J. I. Case Company of Racine, Wis., under its "Uni-Loader" trademark. Except as described hereinbelow, the bucket 20 is similar to buckets that have been made and sold for many years by J. I. Case Company.

As shown in FIGS. 2 through 6, an implement-coupling assembly 30, which enables the bucket 20 to be selectively coupled to and uncoupled from the loader 10, constitutes a preferred embodiment of this invention. Broadly, the assembly 30 comprises a pair of female coupling structures 40, 42, and a pair of male coupling structures 50, 52. The female coupling structures 40, 42, and the male coupling structures 50, 52, respectively are made of steel parts, which are welded together, except as described hereinafter. The female coupling structures 40, 42, which are similar to each other, are welded integrally to the bucket 20 in laterally spaced relation to each other. The male coupling structures 50, 52, which are similar to each other, are mounted operatively to the load-lifting arms and load-tilting pistons of the loader 20 in laterally spaced relation to each other. Thus, the load-lifting arm 12 is journalled at its distal end to the male coupling structure 50, and the load-tilting piston 16 is journalled at its distal end to the male coupling structure 52. Also, the load-lifting arm 14 is journalled at its distal end to the male coupling structure 52, and the load-tilting piston 18 is journalled at its distal end to the male coupling structure 52. Hence, when the male coupling structure 50 is coupled to the female coupling structure 40 and the male coupling structure 52 is coupled to the female coupling structure 42, the bucket 20 may be selectively lifted and lowered, by means of the load-lifting arms 12, 14, and may be selectively tilted by means of the load-tilting pistons 16, 18.

Essentially, as shown, the female coupling structures 40, 42, are mirror images of each other and the male coupling structures 50, 52, are mirror images of each other. Hence, detailed descriptions of the female coupling structure 40 and the male coupling structure 50 will suffice, there being no need for what would be essentially duplicative descriptions of the female coupling structure 42 and the male coupling structure 52.

Figure 2:
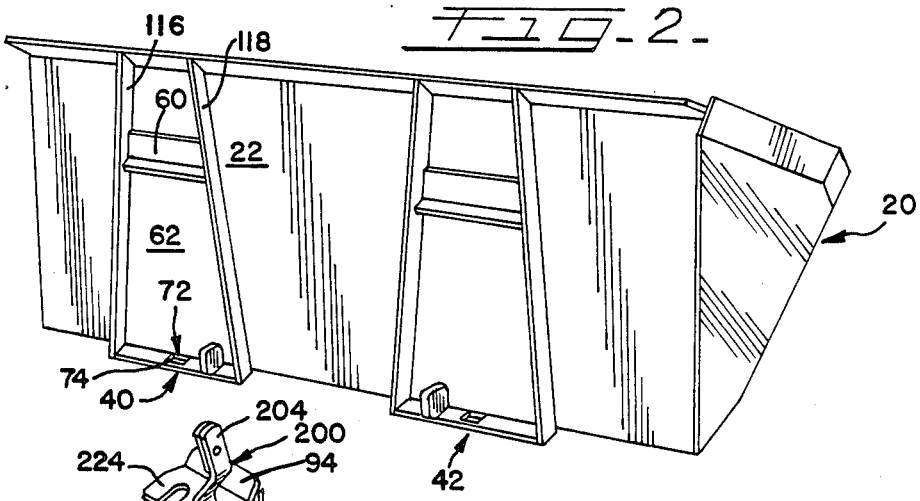
FIG. 2 is a perspective view of the implement shown in FIG. 1, as removed from the skid-steer loader and rotated from front-to-back, on an enlarged scale.
Figure 5:
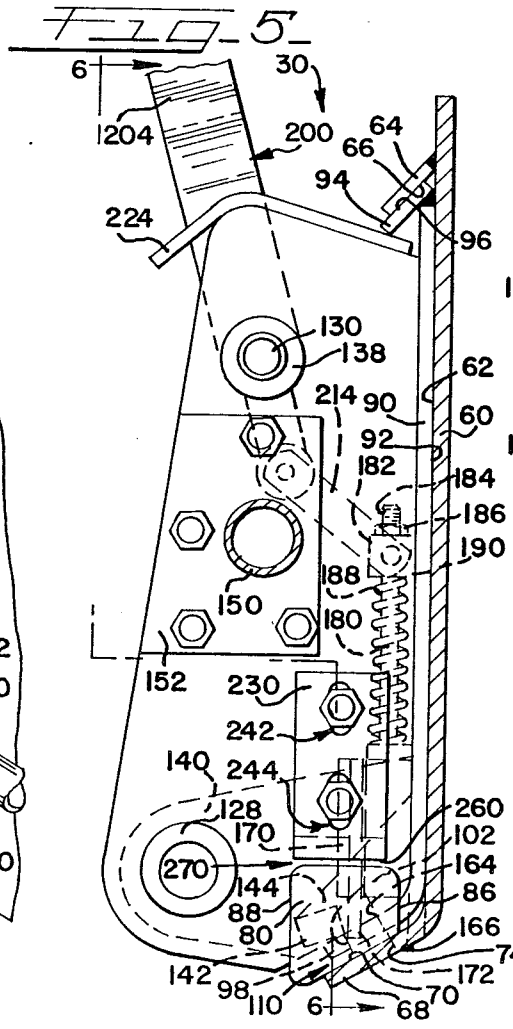
FIG. 5 is a partially elevational and partially sectional view taken substantially along 5—5 of FIG. 4, in a direction indicated by the arrows.
Figure 4:
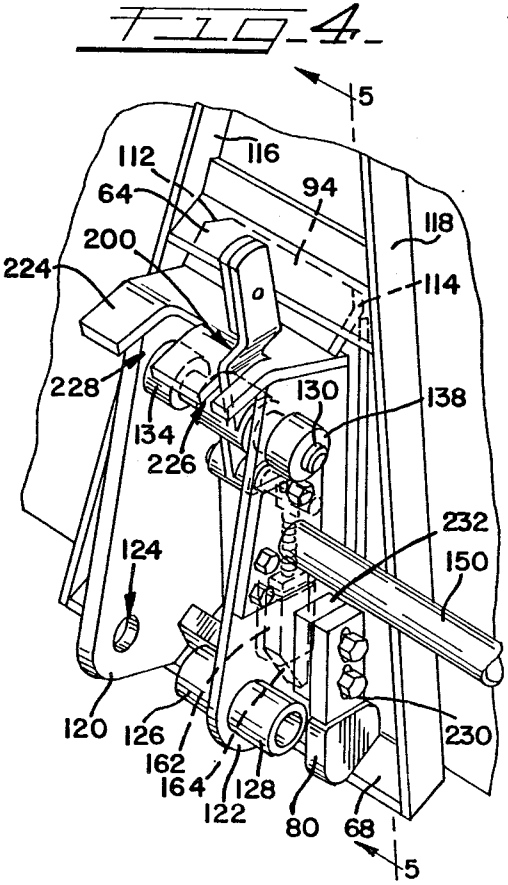
FIG. 4 is a perspective view of the left-hand one of the female coupling structures shown in FIG. 2 and the left-hand one of the male coupling structure shown in FIG. 3, as coupled to each other, on a further enlarged scale.

As shown in FIGS. 2, 4, and 5, the female coupling structure 40, which is integral with the bucket 20, includes an upstanding back plate 60, which has a back surface 62, and which in the preferred embodiment, as shown and described, is a separate plate welded to a back wall 22 of the bucket 20. An upper flange 64 is welded to the plate 60, so as to extend rigidly and backwardly from the plate 60. The flange 64 has a lower surface 66 (see FIG. 5) sloping downwardly and backwardly at an acute angle of approximately 45° from the back surface 62 of the plate 60. The plate 60 is bent, as shown, so as to form a lower flange 68 extending rigidly and backwardly from the back surface 62 of the plate 60. The lower flange 68 has an upper surface 70 sloping downwardly and backwardly at an obtuse angle of approximately 120° from the back surface 62 of the plate 60. The lower flange 68 is provided with an enlarged, generally rectangular aperture 72, which has a back edge 74, for a purpose to be later described.

As shown in FIGS. 2 and 4 through 6, a block 80 is welded to the upper surface 70 of the lower flange 68, so as to be rigidly mounted with respect to the plate 60. The block 80 has an upper horizontal, abutment surface 82, which is flat, as shown. The block 80 has a lower surface 84, which is inclined at an angle, as shown, so as to conform to the flange 68, and vertical front and rear surfaces 86 and 88 respectively. The front surface 86 is spaced rearwardly of and is generally parallel with the back surface 62 of the plate 60.

As shown in FIGS. 3 and 4 through 6, the male coupling structure 50, which is adapted to be operatively mounted to the load lifting arms 12, 14, and load-tilting pistons 16, 18, in a manner to be later described, includes an upstanding front plate 90 having a front surface 92, which in the illustrated embodiment is adapted to bear against the back surface 62 of the plate 60 when the male coupling structure 50 is coupled to the female coupling member 40. Thus, as shown, there is no gap or space between the plate 90 and the plate 60 when the male coupling structure 50 is coupled to the female coupling structure 40. It is to be here understood, however, that it is not necessary for there to be no gap or space therebetween. An upper flange 94 is welded to the plate 90, so as to extend rigidly above the plate 90. The flange 94 has a sloping upper surface 96, which is adapted to bear against the lower surface 66 of the flange 64 when the male coupling structure 50 is coupled to the female coupling structure 40. The plate 90 is bent, as shown, so as to form a lower flange 98 having an enlarged, generally rectangular aperture 100, which has a back edge 102, for a purpose to be later described. A gap 110, as shown, exists between the flange 98 and the flange 68 when the male coupling structure 50 is coupled to the female coupling structure 40.

So as to facilitate coupling of the male coupling member 50 to the female coupling member 40, the outer corners 112, 114, of the flange 94 are beveled, as shown. Moreover, guides 116, 118, are welded to the back wall 22 of the bucket 20. The guides 116, 118, are not parallel to each other but converge as they run upwardly, so as to cooperate with the beveled corners of the flange 94 in causing the flange 94 to become centered between the guides 116, 118, as the flange 64 is lifted under the flange 64.

Moreover, the male coupling structure 50 includes a left-hand vertical bracket 120 and a right-hand vertical bracket 122. A pin (not shown) passing through a circular aperture 124 in the bracket 120, passing through suitable fittings (not shown) at the distal end of the load-lifting arm 12, and passing through bushings 126, 128, mounted on opposite sides of a similar aperture in the bracket 122, connects the male coupling structure 50 operatively, and semi-permanently, to the load-lifting arm 12 in a known manner, so as to permit pivotal movement of the male coupling structure with respect to the load-lifting arm 12, about a horizontal axis disposed transversely with respect to the loader 10. A pin 130 passing through bushings 132, 134, on opposite sides of a circular aperture in the bracket 120, passing through suitable fittings (not shown) at the distal end of the load-tilting piston 16, and passing through bushings 136, 138, on opposite sides of a circular aperture in the bracket 122 connects the male coupling structure 50 operatively, and semi-permanently, to the load-tilting piston 16 in a known manner, so as to permit pivotal movement of the male coupling structure with respect to the load-tilting piston 16. The pin 130 serves another purpose to be later described.

Figure 6:
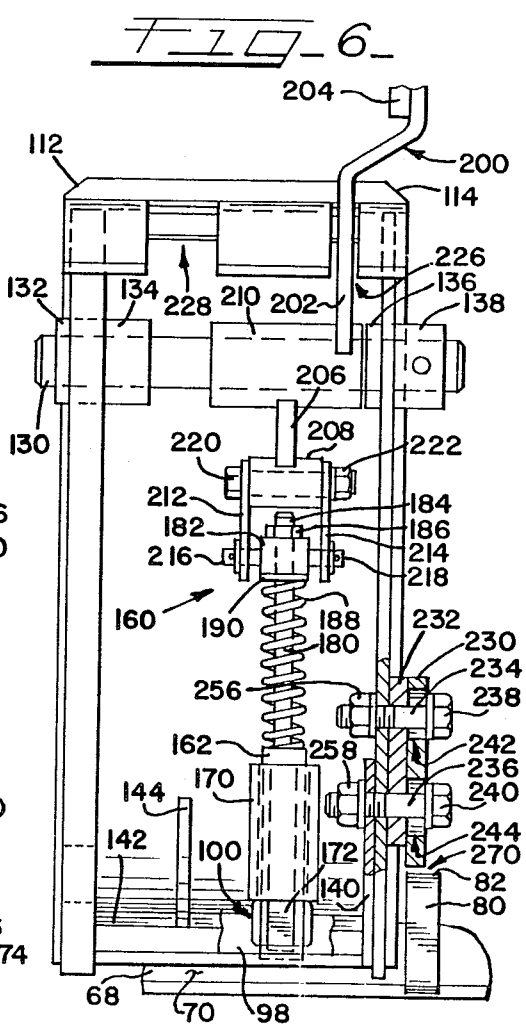
FIG. 6 is a partially elevational and partially sectional view taken substantially along line 6—6 of FIG. 5, in a direction indicated by the arrows, the female coupling structure being shown fragmentarily.

As shown in FIGS. 5 and 6, a gusset 140, which is flush with the bracket 122, and which is welded to the bracket 122 and to the plate 90, reinforces and strengthens the bracket 122. A reinforcing bar 142, which is welded at its opposite ends respectively to the bracket 120 and to the bracket 122, is welded to and along the flange 98. A gusset 144 is welded to the plate 90 and to the bar 142.

Figure 3:
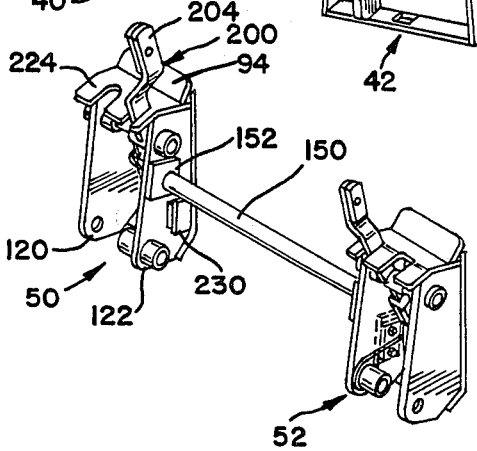
FIG. 3 is a perspective view of the male coupling structures noted above, as removed from the skid-steer loader, rotated front-to-back, and uncoupled from the female coupling structures noted above, on an enlarged scale.

As shown in FIGS. 3 through 5, a tubular brace 150 is welded at its opposite ends respectively to a mounting plate 152, is bolted onto the bracket 122 of the male coupling structure 50, and to a similar plate bolted onto a similar bracket of the male coupling structure 52. The brace 150 resists relative twisting movement of the male coupling structures 50, 52, and maintains a proper spacing between the male coupling structures 50, 52.

Means 160 are provided for latching the male coupling structure 50 releasably to the female coupling structure 40. As shown, the means 160 includes a vertically reciprocatable latch 162 having a back face 164, which is a wedge face, at its lower end 166. The latch 162 is adapted to reciprocate vertically in a latch guide 170, which is welded to the plate 90. An elongated finger 172, which is welded in the guide 170, extends downwardly from the guide 170, into the aperture 100 in the lower flange 98, so as to provide an extended guiding surface for the latch 162. An elongated shank 180, which is integral with the latch 162, extends upwardly from the latch 162, through a slider block 182, and has a threaded end 184 receiving a nut 186. A coiled compression spring 184 is piloted around the shank 180, between the latch 162 and the slider block 182. A washer 190 is disposed around the shank 180, between the spring 188 and the slider block 182.

A manually actuatable lever 200 is used to actuate the latch 162. The lever 200 has a longer arm 202, which ends in an enlarged handle 204, a shorter arm 206, which ends in a transverse sleeve 208, and a central hub 210, by which the lever 200 is mounted pivotally on the pin 130. A pair of links 212, 214, are used to link the slider block 182 to the sleeve 208. The slider block 182 has integral pins 216, 218, to which the lower ends of the links 212, 214, are fastened for pivotal movement. The upper ends of the links 212, 214, are fastened for pivotal movement to the opposite ends of a bolt 220 passing through the sleeve 208 and receiving a nut 22. The shorter arm 206 of the lever 200 and the links 212, 214, form a toggle linkage.

Pivotal movement of the lever 200 from a latch-disengaging position (not shown) to a latch-engaging position causes the toggle linkage to move through its position of maximum leverage to the position wherein the toggle linkage is shown in FIGS. 3 through 6, whereby the latch 162 is urged downwardly, via the spring 188, through the aperture 100 in the flange 98 and through the aperture 72 in the flange 68, until the wedge face 164 of the latch 162 bears against the back edge 74 of the aperture 72. As the wedge face 164 is urged against the edge 74, the plate 90 thus is urged against the plate 60, and the flange 94 thus is urged against the flange 60. Pivotal movement of the lever 200 from the latch-engaging position to the latch-disengaging position causes the toggle linkage to move through its position of maximum leverage, whereby the latch 162 is driven upwardly, via the slider block 182, until the latch 162 is withdrawn from the aperture 72 in the flange 68 and from the aperture 100 in the flange 98.

As shown in FIG. 5, the finger 172 bears against the back edge 102 of the aperture 100 and against the bar 142, so as to transfer some load to the flange 98 and to the bar 142 when the bucket 20 is tilted to dump its contents.

A shroud 224, which is welded on and to the brackets 120, 122, has a narrow slot 226, which accommodates the longer arm 202 of the lever 200, and which serves to limit pivotal movement of the lever 200 to the latch-engaging position, into which the lever 200 is biased by the spring 188 once past the position of maximum leverage of the toggle linkage. The shroud 224 also has a wide slot 228, which accommodates the load-tilting piston 16.

As shown in FIGS. 3 through 6, an adjustable member 230 is mounted to the bracket 122 by guide means, so as to be vertically adjustable with respect to the bracket 122. A spacer 232 is disposed between the member 230 and the bracket 122. Respective upper and lower bolts 234, 236, which have enlarged heads 238, 240, unthreaded shanks, and threaded ends, pass through vertically elongated, vertically spaced, guide slots 242, 244, in the member 230, through suitable apertures in the spacer 232, and through suitable apertures in the bracket 122. The lower bolt 236 also passes through a suitable aperture in the gusset 140. Respective upper and lower nuts 256, 258, are threaded onto the threaded ends of the bolts 234, 236, which thus serve as fixed-position guide members. Washers, as shown, are disposed between the enlarged head 238 of the bolt 234 and the member 230, between the nut 256 and the bracket 122, between the enlarged head 240 of the bolt 236 and the member 230, and between the nut 258 and the gusset 140. The member 230 has a lower, horizontal, abutment surface 260, which is flat, and which is parallel to the upper surface 82 of the block 80 when the male coupling member 50 is coupled to the female coupling member 40.

The member 230 is adjustable via the bolts 234, 236, when the male coupling structure 50 is coupled to the female coupling structure 40, so that the lower surface 260 of the member 230 is spaced from the upper surface 82 of the block 80 by a selected gap 270, which may be precisely limited, as by means of a gauge (not shown) inserted between the surface 260 and the surface 82. The gap 270 serves as a maximum limit to vertical play between the male coupling structure 50 and the female coupling structure 40, even if the gap 110 is greater than the gap 270 because conventional manufacturing tolerances have been used for welded parts of the male coupling structure 50 and the female coupling structure 40, and even if the bucket 20 happens to be heavily laden, so as to impose heavy stresses on various parts of the implement-coupling assembly 30.

The male coupling structure 50 may be quickly coupled to the female coupling structure 40. When the load-lifting arms 12, 14, and the load-tilting pistons 16, 18, are operated to bring the flange 94 under the flange 64 with the wall 90 in a vertical position, the female coupling structure 40 will pivot, if and as necessary to cause the wall 60 to bear against the wall 90, when the male coupling structure 50 is lifted and tilted backwardly, whereupon the means 160 can be manually actuated so as to latch the male coupling structure 50 releasably to the female coupling structure 40. It may not be always necessary then to tilt the male coupling structure 50. The male coupling structure 50 may be quickly uncoupled from the female coupling structure 40, essentially by a reverse sequence of these steps. The gap 270 facilitates proper pivotal action both for coupling and for uncoupling.

The male coupling member 50 will be semi-permanently coupled to the female coupling structure 40 if the member 230 is adjusted via the bolts 234, 236, after the male coupling member 50 has been coupled to the female coupling member 40, so as to eliminate the gap 270. Coupling of the male coupling member 50 semi-permanently to the female coupling member 40 will be particularly advantageous for extended usage of the same implement.

Because the gap 270 can be precisely limited to a specified gap, the gap 270 may be sufficiently large to facilitate proper pivotal action between the male coupler member 50 and the female coupler member 40, both for coupling and for uncoupling, yet sufficiently small to minimize distortion under heavy loads and to minimize risks of the bucket 20 falling off the loader 10.

As mentioned above, the female coupling structure 42 is a mirror image of the female coupling structure 40, and the male coupling structure 52 is a mirror image of the male coupling structure 50. Accordingly, the male coupling structure 52 will be simultaneously coupled to the female coupling structure 42 when the male coupling structure 50 is coupled to the female coupling structure 40, whereupon the means 160 and similar means for latching the male coupling structure 52 to the female coupling structure 42 may be consecutively, in either order, or simultaneously actuated.

As a possible modification, the gap 110 may be eliminated. If the gap 110 is eliminated, a gap may be provided between the plate 90 and the plate 60.

In another possible modification, the latching means noted above may be replaced with automatic latching means, as disclosed in the Cochran et al. patent noted above.

In yet another possible modification, the block 80 may be adjustably mounted to the flange 68, so as to permit the space between the front surface 86 of the block 80 and the back surface 62 and the gap 110 to be simultaneously adjusted, whereupon the member 230 may be fixedly mounted to the bracket 122.

Other modifications may be made to the implement-coupling assembly 30 without departing from the scope and spirit of this invention.

We claim:

1. For use with material-handling apparatus having lifting and tilting means, a combination comprising:

(a) a material-handling implement and a female coupling structure, which is integral with the implement, the implement and female coupling structure together including
  (1) an upstanding back plate having a back surface,
  (2) an upper flange extending rigidly and backwardly from the back plate and having a downwardly and backwardly sloping lower surface, and
  (3) a block mounted to the back plate, the block having an upper surface; and (b) a male coupling structure adapted to be operatively mounted to the lifting and tilting means and to be selectively coupled to and uncoupled from the female coupling structure, the male coupling structure including
  (1) an upstanding front plate having a front surface, which is adapted to be generally parallel to the back surface of the back plate when the male coupling member is coupled to the female coupling structure,
  (2) an upper flange extending rigidly from the front plate and having a sloping upper surface, which is adapted to bear against the lower surface of the upper flange of the female coupling structure when the male coupling structure is coupled to the female coupling structure, and
  (3) a vertical bracket extending rigidly and backwardly from the front plate, and
  (4) a member having a lower surface and being mounted to the vertical bracket so that the lower surface of the member faces the upper surface of the block when the male coupling structure is coupled to the female coupling structure, and (c) means for releasably latching the male coupling structure releasably to the female coupling structure when the male coupling structure is coupled to the female coupling structure;

wherein a selected one of the member and the block is mounted fixedly and wherein the other one of the member and the block is mounted adjustably and is adjustable so that the lower surface of the member and the upper surface of the block are spaced by a selected gap;

whereby vertical play between the male coupling structure and the female coupling structure does not exceed the selected gap between the lower surface of the adjustable member and the upper surface of the block when the male coupling structure is coupled to the female coupling structure.

2. The combination of claim 1 wherein the block is mounted fixedly with respect to the back plate and wherein the member is mounted adjustably with respect to the bracket.

3. The combination of claim 2 wherein the female coupling structure also includes a lower flange extending rigidly and backwardly from the back surface of the back plate.

4. The combination of claim 3 wherein the block is mounted rigidly on the lower flange.

5. The combination of claim 3 wherein the front surface of the front plate bears against the back surface of the back plate and the male coupling structure does not directly engage the lower flange when the male coupling member is coupled to the female coupling member.

6. The combination of any preceding claim wherein the female coupling structure is one of a pair of similar female coupling structures, with which the implement is provided, and wherein the male coupling member is one of a pair of similar male coupling structures, each of which is adapted to be operatively mounted to the lifting and tilting means and to be selectively coupled to and uncoupled from one of the pair of similar female coupling structures.

7. The combination of claim 6 wherein the back plate and upper flange of each female coupling member are welded to the implement.

8. In a coupling assembly comprising a female coupling structure and a male coupling structure, which is adapted to be pivotally inserted into the female coupling structure such that the male and female coupling structures are capable of relative movement after the male coupling structure has been inserted into the female coupling structure, an improvement wherein the coupling assembly comprises:

(a) a fixed block, which is mounted fixedly to a selected one of said structures, the fixed block having an abutment surface;

(b) an adjustable member, which is mounted adjustably to the other one of said structures, the member having an abutment surface facing the abutment surface of the fixed block after the male coupling structure has been inserted into the female coupling structure, the adjustable member being adjustable to a selected position such that the abutment surfaces are spaced from each other by a selected distance, which is sufficiently large to permit the male coupling structure to be pivotally inserted into the female coupling structure but sufficiently small to prevent said male and female coupling structures from inadvertently disengaging from each other despite relative movement between said male and female coupling structure, said adjustable member being mounted for movement by guide means constraining said adjustable member to movement toward and away from said fixed block, said guide means including at least one elongated guide slot in said adjustable member, and a fixed-position guide member projecting through said guide slot and constraining said adjustable member for movement toward and away from said fixed block; and (c) means for securing said adjustable member in said selected position of adjustment.

9. The improvement of claim 8 wherein the fixed block is mounted fixedly to the female coupling structure and the adjustable member is mounted adjustably to the male coupling structure.

10. The improvement of claim 9 wherein said abutment surfaces are generally planar and parallel with one another.

11. The improvement of claim 10 wherein said guide means constrains said adjustable member for movement generally perpendicularly with respect to said abutment surfaces.

12. In a coupling assembly comprising a female coupling structure and a male coupling structure, which is adapted to be pivotally inserted into the female coupling structure such that the male and female coupling structures are capable of relative movement after the male coupling structure has been inserted into the female coupling structure, an improvement wherein the coupling assembly comprises:

(a) a fixed block, which is mounted fixedly to said female coupling structure, the fixed block having a generally planar abutment surface;

(b) an adjustable member, which is mounted adjustably to said male coupling structure, the member having a generally planar abutment surface facing and generally parallel with the abutment surface of the fixed block after the male coupling structure has been inserted into the female coupling structure, the adjustable member being adjustable to a selected position such that the abutment surfaces are spaced from each other by a selected distance, which is sufficiently large to permit the male coupling structure to be pivotally inserted into the female coupling structure but sufficiently small to prevent said male and female coupling structures from inadvertently disengaging from each other despite relative movement between said male and female coupling structure, said adjustable member being mounted for movement by guide means constraining said adjustable member for movement generally perpendicularly with respect to said abutment surface, said guide means including at least one elongated guide slot in said adjustable member extending generally perpendicularly with respect to said abutment surfaces, and a fixed-position guide member projecting through said guide slot and constraining said adjustable member for movement generally perpendicularly with respect to said abutment surface; and (c) means for securing said adjustable member in said selected position of adjustment.

13. The improvement of claim 12 wherein said securing means is associated with said fixed-position guide means.

14. The improvement of claim 13 wherein said fixed position guide member is a bolt having an enlarged head and a shank with an unthreaded length adjacent said head and received in said guide slot, and a threaded outer end; and wherein said securing means includes a nut threadably received on said threaded outer end.

15. The improvement of claim 12 wherein said guide means includes a pair of elongated guide slots in said adjustable member, and a fixed-position guide member projecting through each said guide slot.

16. The improvement of claim 16 wherein said guide slots are positioned in alignment with one another.

17. In a coupling assembly comprising a female coupling structure, said female coupling structure including an upstanding back plate having a back surface and a lower flange having an upper surface disposed at an oblique angle with respect to said back surface, and a male coupling structure which is adapted to be pivotally inserted into the female coupling structure such that the male and female coupling structures are capable of relative movement after the male coupling structure has been inserted into the female coupling structure, an improvement wherein the coupling assembly comprises:

(a) a fixed block, which is mounted fixedly to said female coupling structure, the fixed block having an abutment surface and inclined lower surface mounted on the upper surface of said flange and positioning the abutment surface on said fixed block generally perpendicularly with respect to the back surface of said back plate;

(b) an adjustable member, which is mounted adjustably to said male coupling structure, the member having an abutment surface facing the abutment surface of the fixed block after the male coupling structure has been inserted into the female coupling structure, the adjustable member being adjustable to a selected position such that the abutment surface are spaced from each other by a selected distance, which is sufficiently large to permit the male coupling structure to be pivotally inserted into the female coupling structure but sufficiently small to prevent said male and female coupling structures from inadvertently disengaging from each other despite relative movement between said male and female coupling structures; and (c) means for securing said adjustable member in said selected position of adjustment.

18. The improvement set forth in claim 17 wherein said first block includes front and rear surfaces extending between said abutment surface and said inclined lower surface, said front surface being spaced rearwardly of the back surface of said back plate and generally parallel with said back surface.

19. The improvement set forth in claim 18 wherein said rear surface of said fixed block is spaced rearwardly of said flange.

20. The improvement set forth in claim 19 wherein the front and rear surfaces of said fixed block are generally parallel with one another.

21. In a coupling assembly comprising a female coupling structure and a male coupling structure, which is adapted to be pivotally inserted into the female coupling structure such that the male and female coupling structures are capable of relative movement after the male coupling structure has been inserted into the female coupling structure, an improvement wherein the coupling assembly comprises:

(a) a fixed block, which is mounted fixedly to the female coupling structure, the fixed block having an abutment surface;

(b) an adjustable member, which is mounted adjustably to the male coupling structure, the member having an abutment surface facing the abutment surface of the block after the male coupling structure has been inserted into the female coupling structure, the adjustable member being adjustable to a selected position such that the abutment surfaces are spaced from each other by a selected distance, which is sufficiently large to permit the male coupling structure to be pivotally inserted into the female coupling structure but sufficiently small to prevent said male and female coupling structures from inadvertently disengaging from each other despite relative movement between said male and female coupling structures; and (c) means for securing said adjustable member in said selected position of adjustment;

wherein said adjustable member is mounted for movement by guide means constraining said adjustable member for movement generally perpendicularly with respect to said abutment surfaces; wherein said guide means includes a pair of elongated guide slots in said adjustable member extending generally perpendicularly with respect to said abutment surfaces, said guide slots being positioned in alignment with one another, and a fixed-position guide member projecting through said guide slots and constraining said adjustable member for movement generally perpendicularly with respect to said abutment surfaces; wherein said female coupling structure includes an upstanding back plate having a back surface and a lower flange having an upper surface disposed at an oblique angle with respect to said back surface; wherein said fixed block includes an inclined lower surface mounted on the upper surface of said flange and positioning the abutment surface on said fixed block generally perpendicularly with respect to the back surface of said back plate; and wherein said fixed block includes front and rear surfaces being generally parallel with one another and extending between said abutment surface and said inclined lower surface, said front surface of said fixed block being spaced rearwardly of the back surface of said back plate and generally parallel with said back surface, said rear surface of said fixed block being spaced rearwardly of said flange.

* * * * *

UNITED STATES PATENT AND TRADEMARK OFFICE

CERTIFICATE OF CORRECTION

PATENT NO. : 4,812,103

DATED : March 14, 1989

INVENTOR(S) : Gary L. Cochran et al.

It is certified that error appears in the above-identified patent and that said Letters Patent is hereby corrected as shown below:

In the Abstract, line 13, the word "and" should be "an";

In column 2, line 50, the word "o" should be "to";

In column 11, line 46, the word "to" should be "for";

In column 12, line 25, the word "structure" should be "structures";

In column 12, line 52, the number "16" should be "15";

In column 13, line 23, the word "first" should be "fixed".

Signed and Sealed this

Seventh Day of November, 1989

*Attest:*

JEFFREY M. SAMUELS

*Attesting Officer*

*Acting Commissioner of Patents and Trademarks*